US007211003B2

(12) United States Patent
Halstead

(10) Patent No.: US 7,211,003 B2
(45) Date of Patent: May 1, 2007

(54) POOL TABLE

(76) Inventor: Roger Geoffrey Halstead, 10 Cromlix Close, BR7 5SJ Chislehurst, Kent (GB)

( * ) Notice: Subject to any disclaimer, the term of this patent is extended or adjusted under 35 U.S.C. 154(b) by 0 days.

(21) Appl. No.: 10/221,760

(22) PCT Filed: Mar. 13, 2001

(86) PCT No.: PCT/GB01/01089

§ 371 (c)(1),
(2), (4) Date: Dec. 31, 2002

(87) PCT Pub. No.: WO01/68202

PCT Pub. Date: Sep. 20, 2001

(65) Prior Publication Data

US 2003/0096655 A1 May 22, 2003

(30) Foreign Application Priority Data

Mar. 14, 2000 (GB) ..... 0006129.1

(51) Int. Cl.
*A63D 15/00* (2006.01)
*A63D 15/04* (2006.01)

(52) U.S. Cl. ..... 473/29; 473/31

(58) Field of Classification Search ..... 473/1–43
See application file for complete search history.

(56) References Cited

U.S. PATENT DOCUMENTS

| | | | | | |
|---|---|---|---|---|---|
| 11,799 | A | * | 10/1854 | Kern | 362/159 |
| 136,178 | A | * | 2/1873 | Phelan | 473/32 |
| 156,997 | A | * | 11/1874 | Green | 473/13 |
| 302,196 | A | * | 7/1884 | Eulass | 473/13 |
| 1,656,416 | A | * | 1/1928 | Brinkman | 473/22 |
| 1,661,965 | A | * | 3/1928 | Ruse et al. | 473/13 |
| 1,992,507 | A | * | 2/1935 | Sawyer | 473/15 |
| 2,165,875 | A | * | 7/1939 | Sawyer | 473/15 |
| 2,923,546 | A | | 2/1960 | Santiago | |
| 3,069,163 | A | * | 12/1962 | Schaefer | 473/15 |
| 3,455,551 | A | * | 7/1969 | Untiedt | 473/22 |
| 3,711,099 | A | * | 1/1973 | Milu | 273/123 R |
| 3,729,192 | A | * | 4/1973 | Nielsen | 473/30 |
| 3,941,378 | A | * | 3/1976 | Bagley | 473/10 |
| 4,147,345 | A | * | 4/1979 | McGovern | 473/8 |
| 5,207,790 | A | * | 5/1993 | Eveillard | 473/29 |
| 5,769,729 | A | * | 6/1998 | D'Aguiar | 473/24 |
| 5,830,072 | A | * | 11/1998 | D'Aguiar | 473/33 |
| 6,659,879 | B1 | * | 12/2003 | Cartwright | 473/8 |

FOREIGN PATENT DOCUMENTS

| | | | |
|---|---|---|---|
| FR | 759 306 | | 12/1933 |
| FR | 2 705 034 | | 11/1994 |
| GB | 2 139 509 | | 11/1984 |
| GB | 2326108 | A * | 12/1998 |
| WO | 95/11733 | | 5/1995 |

* cited by examiner

*Primary Examiner*—Mitra Aryanpou
(74) *Attorney, Agent, or Firm*—Lawrence E. Laubscher, Jr.

(57) ABSTRACT

A pool table or the like (10) is formed from a trough (20) whose edges support the bed (12) of the table and have the cushions (34) attached to them. The trough includes means for directing potted balls in a particular manner, which may be in the form of channels (28). Sound-deadening material may be provided on the trough. The cushions can be attached to the trough by clips (56), pegs (90) or conventional means. The invention also extends to the trough itself, and to a method of assembling a table with a trough.

10 Claims, 4 Drawing Sheets

POOL TABLE

BACKGROUND OF THE INVENTION

1. Field of the Invention

The present invention relates to a pool table or the like on which pool, snooker or similar games can be played, and in particular to a table which can also serve as a dining table.

2. Description of the Related Art

Snooker tables are of course well known. Further, snooker tables which can also serve as dining tables (hereinafter referred to as "snooker/dining tables") are known. When it is desired to convert the table from its snooker form into its dining form, one or more covers are laid across the table, extending from one side to the other and supported on the cushions or the cushion surrounds. These covers form the surface of the dining table. It is also normally necessary to lower the height of the table, as the optimum height for the playing surface of a snooker table is several centimetres greater than the optimum height for a dining table, and mechanisms for adjusting the height in this manner are well known.

The use of such a table as a dining table imposes strict requirements on the allowable size of the top of the table. In particular, when the table is to be used as a dining table, the lower surface of the table top should be at least around 21.5 inches (around 55 cm) above the ground, to allow diners to fit their legs under the table top when seated. However, the upper surface should not be more than around 29 inches (around 74 cm) above the ground, as it is awkward to eat at a height greater than this. Thus, the total thickness of the table top, including the covers, should not exceed 7.5 inches (19 cm).

This does not normally pose a great problem in the context of snooker/dining tables. The thickness of a snooker/dining table top is made up of the thickness of the bed (normally made from slate or some similar flat and stiff material), the height of the cushions (which extend upwardly from the bed), and the thickness of the covers forming the dining surface. In addition, if there is a bed support, its thickness must also be taken into account. The total thickness is normally only a few inches.

In part, this stems from the nature of the game of snooker itself In snooker, it is often necessary for a ball to be placed on the table after it is potted. The contents of the pockets of a snooker table must therefore be easily accessible during a game, to facilitate this replacement. The pockets are commonly formed as shallow net bags, hanging from the bed and the cushions. It is easy for a person using the table as a snooker table to reach a hand into the pocket to retrieve a ball. Pockets of this type do not take up much space, and in any event will not inconvenience a diner.

However, in the game of pool, the situation is rather different. Once a ball is potted in pool, it is never replaced on the table. Pool tables, and in particular coin-operated pool tables of the sort found in pubs, bars and so on, normally include means for collecting and retaining the balls after they are potted. In coin-operated tables, these means can be operated to release the balls following insertion of the necessary coinage, in preparation for the next game.

One common way of achieving this is to provide channels leading from each of the pockets to a central collection point, and a further channel leading from the collection point to a region where the balls can be removed. This further channel can be blocked by a bar or the like, which is retracted or lifted when the necessary coins are inserted. Alternative arrangements are of course possible, and are known in the art. The channels are commonly formed from pairs of rails, along which the balls run.

A further complication arises from the chance that the cue ball will be accidentally potted by a player during a game of pool. Clearly, if this occurs, it is necessary to return the cue ball, to enable the following player to take his or her shot, and so it is necessary to separate the cue ball from the other balls (the "object balls") and prevent it from being collected with them.

A common solution to this problem is to make the cue ball with a slightly smaller diameter than the object balls. The further channel can then be provided with a cut-away region having a size such that the cue ball can fall through it, but the object balls cannot. If the channel is formed from a pair of rails, then these can have a region where the distance between them is greater than the diameter of the cue ball but smaller than the diameter of the object balls. After falling through this region, the cue ball can be led (for example by means of another channel) to a region where it can be removed from the table by the players and used in the next shot.

Alternative means for separating the cue ball from the object balls are also known in the art.

It will be appreciated that these means for separating the cue ball from the object balls, and for returning the balls to specified regions, can take up a considerable amount of space. Indeed, in coin-operated tables, the mechanism can have a total thickness (measured downwardly from the top of the cushions) of around 15 inches (38 cm). Obviously, it is impossible to use mechanisms of this nature and size in a pool/dining table.

SUMMARY OF THE INVENTION

According to a first aspect, the invention provides a pool table, wherein the body of the table is formed from a trough, whose edges support the bed of the table and have the cushions attached thereto, the trough being provided with means disposed under the bed for directing potted balls in a desired manner.

Having a trough which supports the bed of the table and to which the cushions are attached simplifies the assembly of the table. Further, the means for directing the potted balls can be formed with the trough, thus further reducing assembly time and the thickness of the table top.

The trough can support the bed in any suitable manner. However, in a preferred embodiment, the trough is generally bowl shaped, with a horizontal inwardly projecting lip to support the bed.

Further, the cushions can be attached to the trough in any convenient way. However, it is preferred that the trough also comprises an edge portion, extending upwardly from the lip, to which the cushions are attached.

The table can also comprise additional supports for the bed.

In a preferred form, the means for directing balls is in the form of a plurality of channels leading from the pockets to a collection point. In an alternative embodiment, the means for directing balls is provided by the lower surface of the trough being generally dish-shaped, with the collection point at the lowest point of the dish.

It is envisioned that the pool table of the invention will be used as a pool/dining table in a domestic environment. Preferably, sound deadening material is provided in at least some of the regions of the trough which are contacted by balls. This reduces the noise produced by the table during play.

The cushions can be retained on the edge portions in any suitable manner. For example, a screw can pass through the edge portion and engage in the body of the cushion, thus retaining it. However, it is preferred for the cushions to be attached to the trough by at least one clip.

Preferably, the clip has two legs which are resiliently attached to each other, one of the legs being attached to the cushion and the other of the legs passing through an opening in an edge portion of the trough. This other leg of the clip may bear on the side of the edge portion which is distant from the cushion. This arrangement serves to retain the cushions very well, and also allows them to be removed, for example if the table is to be renovated, very easily.

Indeed, this aspect of the invention is considered to be of independent inventive merit, and so according to a further aspect of the invention, there is provided a pool table, wherein at least one cushion of the table is attached to the body of the table by at least one clip.

Preferably, the tables described above can also serve as dining tables.

The invention also extends to a trough for use in a table as described above. The trough may be formed from more than one part.

The invention also extends to a method of assembling a pool table, comprising the steps of providing a trough with edges for supporting a bed and for the attachment of cushions, the trough being provided with means for directing potted balls in a desired manner, laying the bed in the trough so that it is supported by at least the edges, and attaching cushions to the trough. It is preferred that at least one cushion is attached to the trough by at least one clip.

BRIEF DESCRIPTION OF THE DRAWINGS

Preferred embodiments of the invention will now be described by way of example only and with reference to the accompanying drawings, in which.

DETAILED DESCRIPTION

Figure 1:
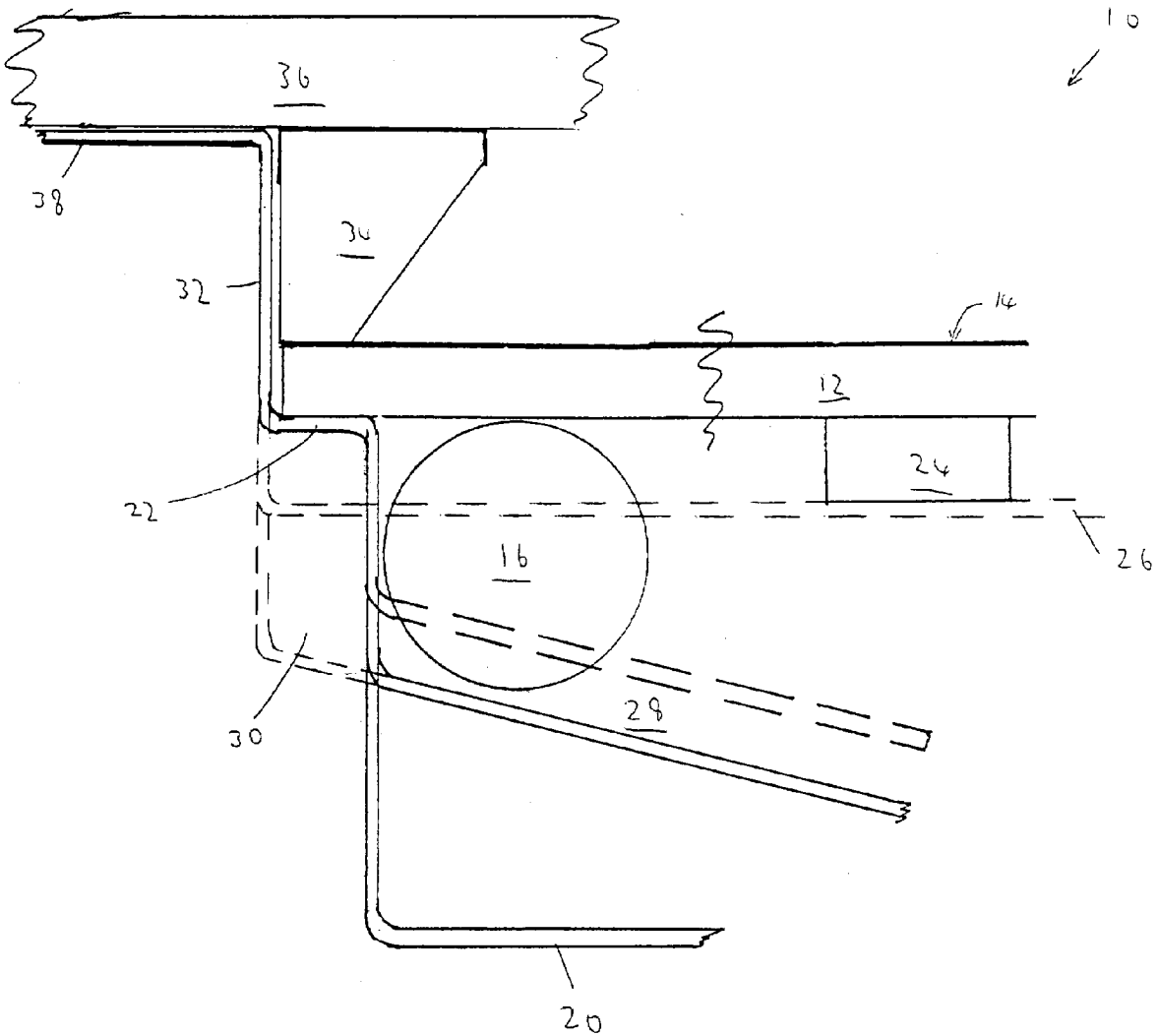
FIG. 1 is a schematic cross-section of a table according to a preferred aspect of the invention.

The invention is best described with reference to FIG. 1, which as mentioned above shows a schematic cross-section through the side of a pool/dining table 10. The table includes a bed 12, whose upper surface is covered with cloth 14 and which forms the pool playing surface. The edges of the bed 12 rest on the lip 22 of a trough member 20, which is substantially coextensive with the bed 12 and extends upwardly and downwardly therefrom. Additional support members 24 can be provided extending across the table to reduce the risk of the bed 12 sagging, and a region of the trough formed to position such a support member is shown in phantom at 26.

Beneath the bed 12, the trough 20 is formed in a generally dished shape. In a preferred embodiment, shown in the drawings, the trough is formed with channels 28 for directing balls 16 from the regions directly underneath the pockets to a particular region of the trough 20. The channels 28 slope downwardly toward this region of the trough 20. In this way, when a ball 16 is potted and falls through the cut-out (not shown) in the bed 12 onto the trough 20, it moves under gravity to the region of the trough. Suitable means can be provided for guiding the balls 16 from the region of the table to a collection point. In one embodiment, the region to which the balls are directed is the centre of the trough; however, it will of course be appreciated that the region need not be in the centre of the table, but can be in any desired convenient position.

It will be appreciated that at the pockets of the table, the bed 12 is cut away to allow the ball 16 to drop. The trough 20 is formed with a bulge at these points, shown in phantom at 30, to allow the ball to drop cleanly into the channel 28.

In an alternative form, the trough 20 is not formed with channels, but the dish shape is more pronounced. Any balls potted will automatically run to the lowest part of the trough, from where they can again be led to a collection point.

Figure 5:
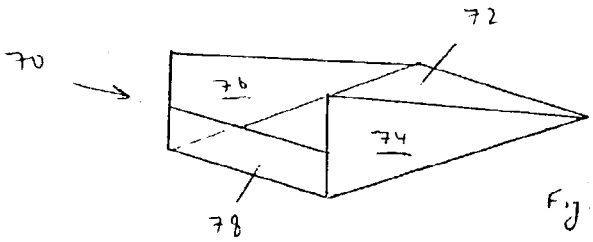
FIG. 5 is a view of a part of the trough which allows balls to be retrieved.

The balls can be removed from the table at the collection point. In a first preferred embodiment, a part of the trough is hingedly attached to the remainder of the trough. Such a part is shown schematically in FIG. 5, and generally indicated by the reference numeral 70. As will be seen from that Figure, the part 70 is generally wedge-shaped, with a lower wall 72, side walls 74, 76 and an end wall 78, which is preferably not as high as the side walls. The side of the lower wall 72 opposite to the end wall 78 is hinged to the remainder of the trough.

Figure 6A:
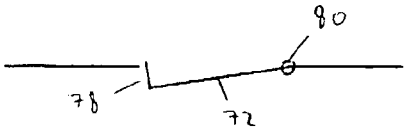
FIGS. 6*a* and 6*b* are side views showing how the part of the trough allows balls to be retrieved.

Normally, the part is in an upper position, shown schematically in FIG. 6*a*, where the lower wall 72 slopes away from the hinge 80. In use, potted balls are led to the region where the part is hinged to the trough, and the balls roll along the lower wall 72 to the end wall 78 as a result of the slope of the lower wall. The motion of the balls is constrained by the side walls, so that the balls collect by the end wall. The hinged part can be retained in this position by a latch or similar.

Figure 6B:
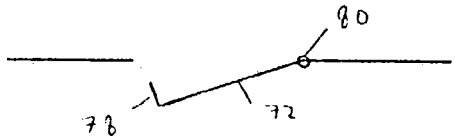

When it is desired to remove the balls, the latch is disengaged, and the part 70 is rotated about the hinge 80 into a lower position as shown in FIG. 6*b*. This allows a user to reach a hand in over the end wall 78 and retrieve the balls. Once the balls have been retrieved, the hinged part can be returned to its original position. Alternatively, it can remain in its lower position, which simplifies the removal of the cue ball if it is potted.

It is possible to provide the hinged part with a lock, allowing it to be locked in its upper position. This can prevent unauthorized use of the table.

Further, means may be provided for separating the cue ball from the object balls and delivering it to a different collection point.

Above the bed 12, the edges 32 of the trough 30 extend upwardly. The cushions 34 of the pool table are attached to these edges 32. The height of the vertical extent of the edges 32 is approximately equal to the thickness of the cloth-covered bed 12 and the height of the cushions 34.

The edges of the trough can also extend horizontally, level with the top of the cushions, as shown at 36. This provides a region surrounding the cushions on which a player can rest his or her bridge hand when playing a shot where the cue ball is close to the cushion 34. Of course, the surround can be formed as a separate member.

As mentioned above, the systems for guiding potted balls in known pool tables take up a large amount of space, and in particular are too thick (from top to bottom) to be used in a pool/dining table. However, using a trough as described above allows the system for guiding potted balls to be much reduced in size.

As an example, sample dimensions for the trough will be given, although it will of course be understood that these are examples only.

Routinely, the bed has a thickness of around 0.5 inches (13 mm), and the cushion has a height of 1.5 inches (36 mm). The covers which are put on top of the cushions to turn the table into a dining table have a thickness of around 0.75 inches (18 mm). The lowest point of the trough is around 3.5 inches (90 mm) below the underside of the bed, to allow the table to be used with balls of a diameter of around 2 inches (51 mm). With the inclusion of around an eight of an inch (3 mm) for the thickness of the material from which the trough is formed, the total thickness of the table top when used for dining is around 6.25 inches (160 mm), well within the 7.5 inch (19 cm) limit.

The trough 20 can be formed from any material of sufficient stiffness and strength to support the bed 12 and cushions 34 securely. Suitable materials include plastics, fibre-reinforced plastics such as fibreglass, sheet metal such as aluminium, medium density fibreboard (MDF), and wood, although other materials can also be contemplated. The method of forming the trough 20 will of course depend on the material from which it is formed, but moulding, pressing and vacuum-forming are all particularly suitable methods.

It will be appreciated that the trough 20 has a total height (from its lowest point to its highest point) of around 6.25 inches (160 mm), and, in the embodiment shown, has sides which are generally vertical. This can cause difficulties if, for example, the trough 20 is being pressed or vacuum-formed from a single sheet, as then the original plane of the sheet will form the horizontal extent 36, parallel with the top of the cushions 34. Pressing such a deep trough 20 with vertical sides can lead to weakening or even tears in the material, especially at the corners.

Figure 2A:
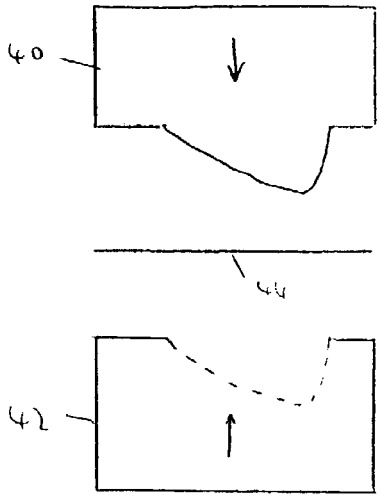
FIGS. 2*a* and 2*b* show a method of forming a part of the table.
Figure 2B:
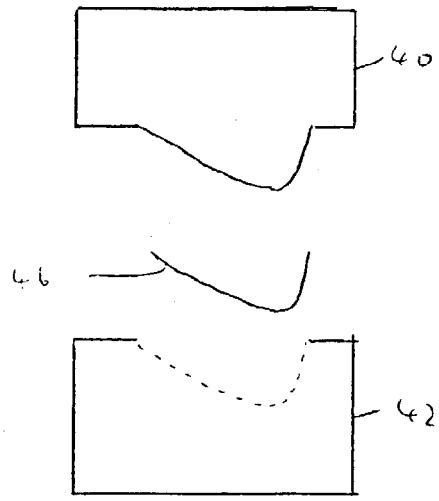

To overcome this problem, the trough 20 can be formed with the sides having a more gentle slope. Alternatively, the trough 20 can be formed from a number of separate pieces, each of which is formed individually. The pieces can be pressed from separate sheets so that the formation of vertical parts (ie parts which are perpendicular to the original plane of the sheet being pressed) can be avoided. This is shown schematically in FIGS. 2*a* and 2*b* where upper and lower tools 40, 42 are used to press a section 46 of the trough 20 from a sheet 44 of material.

As mentioned above, when a ball 16 is potted, it drops onto the surface of the trough 20. The impact of the ball on the trough creates a certain amount of noise, and this can be undesirable, particularly if the table is being used as a pool/dining table in a domestic environment. To overcome this problem, sound deadening material can be disposed in the channels, or (where the trough is not formed with channels) on the surface of the trough itself. Alternatively, the channels or the surface of the trough can be treated so as to reduce the amount of noise generated in this way.

Assembly of the table is as follows. Firstly, any additional support members 24 which may be required are placed in the trough 20. Then the covered bed 12 is laid in the trough 20, and is supported at its edges, and by any additional support members which may be used. Cushions 34 are attached to the upstanding edges 32 of the trough 20. The assembly of the trough, bed and cushions is then inserted into a frame, which may be directly attached to a table, or may be attached to a height adjustment mechanism which is attached to the table.

There are various ways of attaching the cushions to the trough. In the prior art, cushions have been attached to tables by screwing, or by over-centre clamps. It is vital that the cushion is firmly attached to the table. If there is any slack, then the cushion will move when a ball hits it, absorbing a great deal of the kinetic energy of the ball and reducing the speed at which the ball bounces off.

Screwing or clamping the cushion to the table succeeds in firmly attaching it, but can make it difficult to remove the cushion, which is necessary if the cloth on the bed is to be replaced. In particular, if the cushion is screwed to the table, then it is normally necessary to remove a surround before the screw can be accessed, and removal of the surround may itself involve further dismantling of the table.

In the preferred embodiment, the cushions are attached to the upstanding edges of the trough by clips. A cushion which can be attached in this way is shown in FIG. 3, and the cushion is shown in its attached state in FIG. 4.

Figure 3:
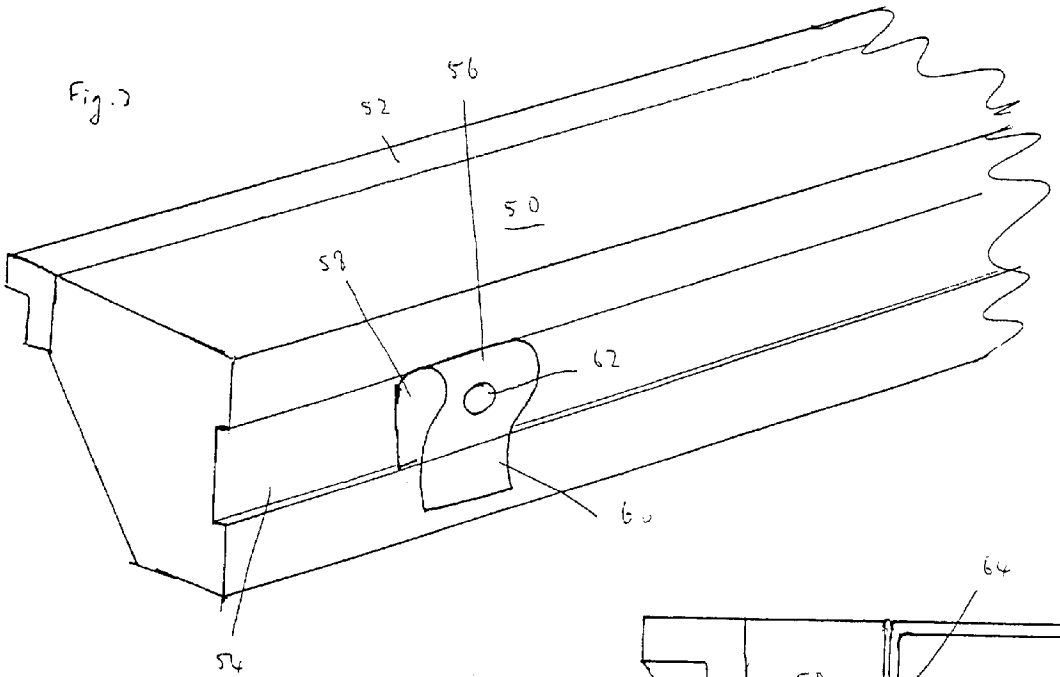
FIG. 3 is a schematic view of a cushion for use with the table.

The cushion of FIG. 3 comprises a rail 50 made of wood or any other suitable material. A strip 52 of elastomeric material is attached to the rail 50, and it is this strip 52 which the balls contact. The strip 52 and rail 50 are normally covered with cloth.

On the side opposite to that where the strip 52 is attached, the rail 50 has a recess 54, and one end 58 of a clip 56 is attached to the floor of the recess 54 by a screw. The free end 60 of the clip 56 has an aperture 62 through it, to allow a screwdriver to access the head of the screw. Of course, the cushion 34 is provided with as many clips 56 as are necessary to hold it in place. In addition, any other suitable method of attaching the clips 56 to the rail 50, such as gluing, can be used. The rail can also have an aluminium profile section inserted into the recess, for additional strength.

Figure 4:
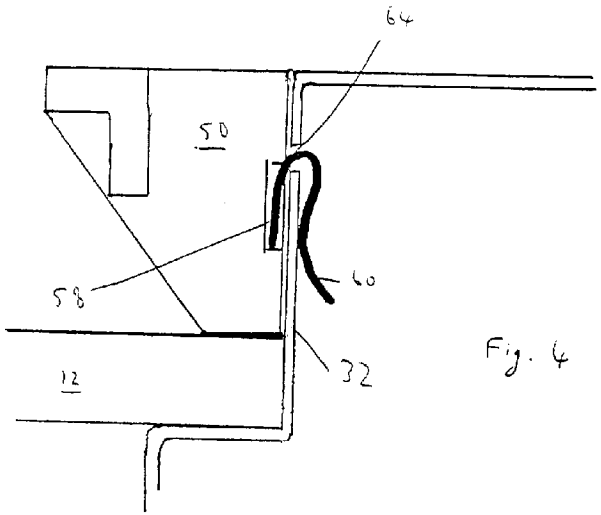
FIG. 4 is a cross-sectional view of the cushion installed on the table.

The upstanding edges 32 of the trough are formed with openings 64 therethrough, and these can be seen in FIG. 4. These openings 64 can be formed when the trough 20 as a whole is formed, or in a subsequent step.

To mount the cushions 34 on the trough 20, the free end 60 of the clip 56 is threaded through the opening 64. The cushion 34 is then pressed downwardly, so that the clip 56 arrives at the position shown in FIG. 4. Here, it will be seen that the free end 60 of the clip 56 is in contact with a face of the upstanding edge 32 of the trough 20. As a result, the cushion 34 is held tightly on the trough, as is necessary to provide a good bounce characteristic.

In this embodiment, the free end of the clip is in direct contact with a face of the upstanding edge of the trough. However, this can cause problems depending on the material from which the trough is formed. In particular, fibreglass is prone to wear in this type of situation, and so in an alternative embodiment the edge of the trough can be provided with a reinforced region which the clip contacts. This reinforced region can be in the form of a piece of aluminium sheet attached to the edge of the trough at the area where the clip contacts.

Similar reinforcing regions can also be used if the cushion is to be attached to the edge of the trough by means of screws.

The cushions 34 can be easily removed in the event that this is required, by simply levering them upwardly from one end.

Figure 7:
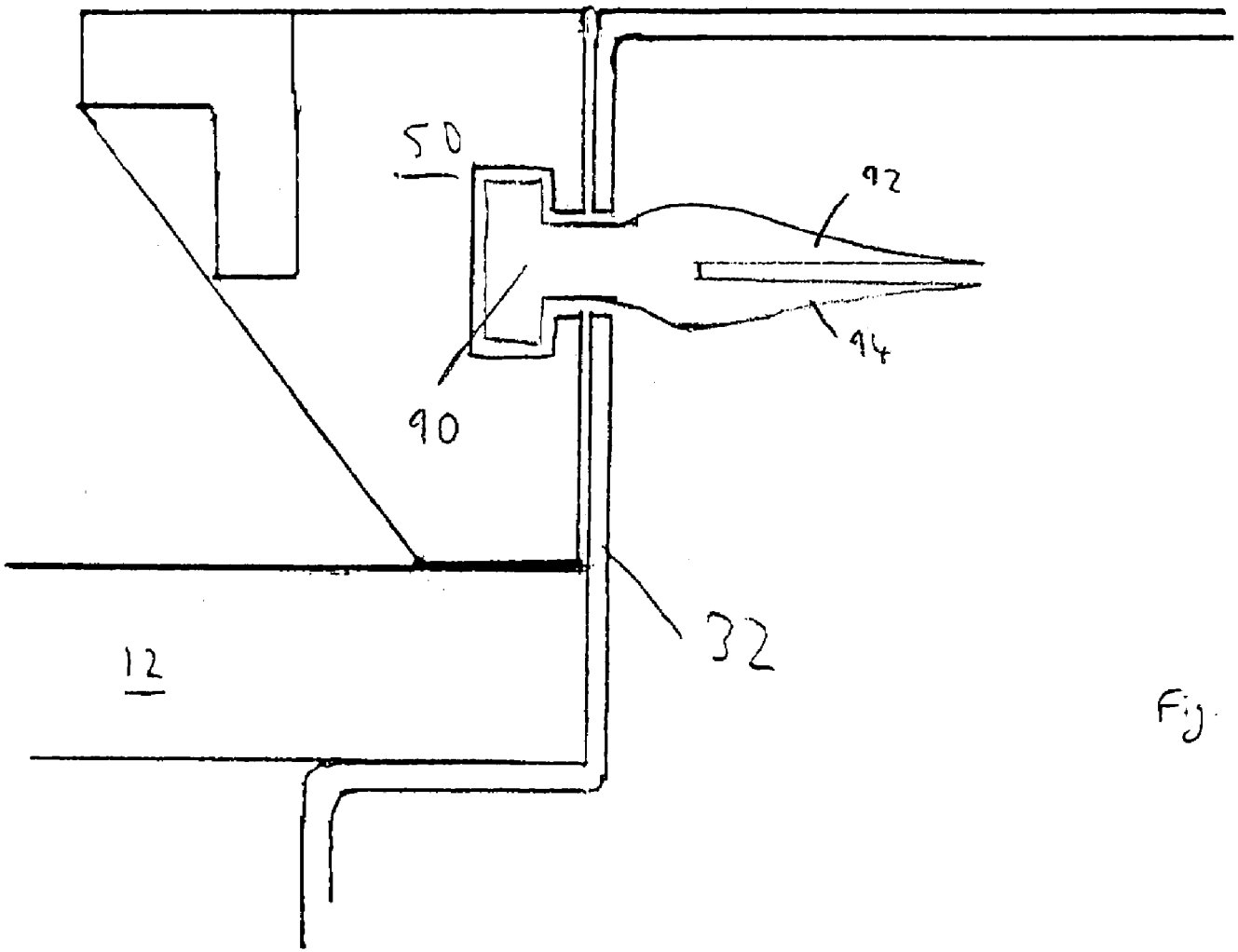
FIG. 7 is a cross-sectional view of a cushion installed on the table in an alternative embodiment.

Alternative forms of clips can also be used to attach the cushions. For example, FIG. 7 shows a method of attachment in which pegs 90 are attached to the cushions. The pegs are formed from a resilient material, and the ends of the pegs are slit and tapered, so that the halves 92, 94 of the peg can be pushed together. To attach the cushions, the ends of the pegs are located in holes in the edge of the trough, and the cushion is pushed towards the trough. This pushes the pegs into the holes, compressing the halves of the peg. When the peg is fully inserted, the halves spring back into their original position as a result of the resilience of the material from which the peg is formed, and so hold the cushion in place.

Of course, it will be appreciated that this method of attaching cushions to tables is of general applicability, as is the idea of using a trough to support the bed and the cushions. Thus, the invention should not be construed as being limited to pool/dining tables, but also extends to ordinary pool tables, billiard tables and snooker tables.

The invention claimed is:

1. A combination pool and dining table, comprising:

a bed having edges and containing a plurality of spaced pockets; and a low profile trough formed from one of a molded and sheet material, said trough having edges including an inwardly-projecting lip which supports the edges of the bed, the edges of the trough extending above the edges of the bed, and further wherein cushions are attached to the edges of the trough, the trough extending from the edges of the bed under the entire bed for supporting the bed, the trough further being provided with means disposed substantially under the entire bed for directing potted balls from the plurality of pockets to a common collection point.

2. A table as claimed in claim 1, wherein the trough is generally bowl shaped.

3. A table as claimed in claim 1, wherein said trough includes additional supports across the top surface thereof for supporting the bed in an area intermediate the edges thereof.

4. A table as claimed in claim 1, wherein said means for directing balls is provided in the form of a plurality of channels leading from the pockets to a collection point.

5. A table as claimed in claim 1, wherein said means for directing balls is provided by a lower surface of the trough being generally dish-shaped, with a collection point at a lowest point of the dish.

6. A table as claimed in claim 1, wherein a sound deadening material is provided in at least some regions of the trough which are contacted by balls.

7. A table as claimed in claim 1, wherein at least one cushion is attached to the trough edge by at least one clip.

8. A table as claimed in claim 7, wherein said clip has two legs which are resiliently attached to each other, one of said legs being attached to said cushion and the other of said legs passing through an opening in a vertical edge portion of the trough.

9. A table as claimed in claim 8, wherein said other leg of said clip means bears on a side of said edge portion which is distant from the cushion.

10. A trough as claimed in claim 1, wherein said trough is formed from more than one part.

* * * * *